US012799734B2

(12) United States Patent
Vandenbempt

(10) Patent No.: US 12,799,734 B2
(45) Date of Patent: Nov. 17, 2026

(54) INSERT PIECE, BUILDING BLOCK PROVIDED WITH SUCH INSERT PIECE AND WALL MADE WITH SUCH BUILDING BLOCKS

(71) Applicant: VANDENBEMPT PATENT BV, Wilsele (BE)

(72) Inventor: Patrick Vandenbempt, Wilsele (BE)

(73) Assignee: VANDENBEMPT PATENT BV, Wilsele (BE)

( * ) Notice: Subject to any disclaimer, the term of this patent is extended or adjusted under 35 U.S.C. 154(b) by 126 days.

(21) Appl. No.: 18/879,057

(22) PCT Filed: Jun. 26, 2023

(86) PCT No.: PCT/IB2023/056566
§ 371 (c)(1),
(2) Date: Dec. 26, 2024

(87) PCT Pub. No.: WO2024/003697
PCT Pub. Date: Jan. 4, 2024

(65) Prior Publication Data

US 2025/0382792 A1 Dec. 18, 2025

(30) Foreign Application Priority Data

Jun. 27, 2022 (BE) ..... 2022/5511

(51) Int. Cl.
*E04B 2/08* (2006.01)
*E04B 2/02* (2006.01)

(52) U.S. Cl.
CPC ..... *E04B 2/08* (2013.01); *E04B 2002/0245* (2013.01)

(58) Field of Classification Search
CPC ..... E04B 2/08; E04B 2002/0245; E04B 2/18
See application file for complete search history.

(56) References Cited

U.S. PATENT DOCUMENTS 2,241,169 A * 5/1941 Yokes ..... E04B 1/12 52/262
2,700,295 A 1/1955 Gilde
(Continued)

FOREIGN PATENT DOCUMENTS

EP 2831347 B1 11/2018
WO 2022053894 A1 3/2022

OTHER PUBLICATIONS

International Search Report and Written Opinion dated Feb. 29, 2024, pertaining to Int'l Patent Application No. PCT/IB2023/056566, 8 pgs.

*Primary Examiner* — Rodney Mintz
(74) *Attorney, Agent, or Firm* — Dinsmore & Shohl LLP

(57) ABSTRACT

Insert piece provided with first coupling parts and complementary second coupling parts that cooperate with each other for mutually coupling insert pieces wherein the insert pieces are provided with a foot in which through holes are provided, whereby two spacers extend on the foot on which the first and second coupling parts are provided, whereby a first part of the through holes is located in the extension of the spacers and a second part of the openings is located next to the spacers, such that a first insert piece can be coupled to a second insert piece by inserting the first coupling parts of the first insert piece through the through holes next to the spacers of the second insert piece and moving them until the first coupling parts cooperate with the second coupling parts.

11 Claims, 3 Drawing Sheets

(56) References Cited

U.S. PATENT DOCUMENTS 2,844,022 A * 7/1958 Klem ..... E04B 2/08 52/603
3,180,059 A * 4/1965 Persak, Jr. ..... E04B 2/18 52/503
3,180,060 A * 4/1965 Persak, Jr. ..... E04B 2/18 52/592.1
3,852,909 A * 12/1974 Viebcke ..... E04B 1/12 446/128
4,110,949 A * 9/1978 Cambiuzzi ..... E04B 2/42 52/437
4,136,498 A * 1/1979 Kanigan ..... E04B 2/08 52/438
5,771,654 A * 6/1998 Moore ..... E04B 2/54 52/745.1
7,517,270 B2 * 4/2009 Marzetta ..... A63H 33/101 446/85
8,667,750 B2 * 3/2014 Speer ..... E04B 2/16 52/582.1
9,206,598 B2 * 12/2015 Phillips ..... E04B 2/16
9,593,480 B2 * 3/2017 Vandenbempt ..... E04B 1/388
9,689,160 B2 6/2017 Lanese
10,106,980 B2 * 10/2018 Martinez ..... E04B 2/08
10,273,685 B2 * 4/2019 Martinez ..... E04C 1/397
10,781,588 B1 * 9/2020 Nadeau ..... E04C 5/163
11,512,482 B2 * 11/2022 Alvarez Bonilla ..... E04G 21/18
11,566,420 B2 * 1/2023 Kim ..... E04B 2/24
11,718,985 B2 * 8/2023 Walker ..... E04B 2/30 52/284
12,163,329 B2 * 12/2024 Deen ..... E04B 2/16
2007/0277459 A1 * 12/2007 Marzetta ..... A63H 33/101 52/281
2008/0075528 A1 * 3/2008 Marzetta ..... A63H 33/108 403/238
2013/0036700 A1 * 2/2013 Speer ..... E04C 1/00 52/745.1
2013/0212956 A1 * 8/2013 Olaes ..... E04G 21/1883 52/127.1
2015/0075106 A1 * 3/2015 Vandenbempt ..... E04B 1/388 52/596
2015/0082733 A1 * 3/2015 Phillips ..... E04B 2/16 52/604
2015/0300006 A1 * 10/2015 Lanese ..... E04C 1/39 52/745.1
2018/0044914 A1 * 2/2018 Martinez ..... E04B 2/08
2019/0048581 A1 * 2/2019 Martinez ..... E04C 1/397
2019/0292801 A1 * 9/2019 Alvarez Bonilla ..... E04G 23/0218
2021/0293018 A1 * 9/2021 Deen ..... E04B 2/16
2022/0002993 A1 * 1/2022 Kim ..... E04B 2/24
2022/0112712 A1 * 4/2022 Walker ..... E04B 2/30
2024/0392561 A1 * 11/2024 Howell ..... E04B 2/18
2025/0084636 A1 * 3/2025 Deen ..... E04B 2/08

* cited by examiner

INSERT PIECE, BUILDING BLOCK PROVIDED WITH SUCH INSERT PIECE AND WALL MADE WITH SUCH BUILDING BLOCKS

CROSS-REFERENCE TO RELATED APPLICATIONS

The present application is the National Phase entry of International Patent Application No. PCT/IB2023/056566 filed Jun. 26, 2023, which claims priority to Belgium Patent Application 2022/5511 filed Jun. 27, 2022.

TECHNICAL FIELD

The present disclosure relates to an insert piece for a building block

In particular, the present disclosure relates to an insert piece for a building block, whereby the building block is intended for erecting walls and partitions of a building.

Building blocks with coupling means with a first coupling part that protrudes from a first surface of the building block and a second coupling part complementary thereto on an opposite surface of the building block are already known.

The first and the second coupling part are complementary and when assembling various such building blocks, the first coupling part of a first building block and the second coupling part of an adjacent building block can cooperate with each other for coupling the relevant building blocks.

The building block is thereby formed from a prismatic body in which one or more synthetic insert pieces are applied or embedded. The first and second coupling parts are formed by the synthetic insert pieces.

BACKGROUND

A disadvantage of the known building blocks is that after assembly, the building blocks have a great joint height, typically approximately fifteen millimetres.

Due to the considerable joint height, a foot of the insert pieces is always visible in the horizontal joints, more specifically, the joints running parallel with the foundations of the building or the construction.

Aesthetically this is a disadvantage of course. For this reason the joints are still grouted with, for example, a strip or considerable quantities of mortar.

Insert pieces whereby the visible section of the foot is roughened or is provided with a relief that ensures that the visible section of the foot looks like a traditional joint also exist.

Building blocks whereby the prismatic body is provided with a recess or cavity on its bottom surface in which the foot of the insert piece can be concealedly applied also exist.

'The bottom surface of the prismatic body' here refers to the surface intended to be placed on the foot of the insert piece, or the surface oriented toward the foundation of the building or construction.

A disadvantage of such building blocks is that the prismatic bodies must be made in a special mould, which increases the production cost.

Also, there is only one possible way in which the prismatic bodies can be correctly placed, namely with the cavity or recess oriented toward the foot of the insert piece.

A user or builder will thus possibly have to rotate the prismatic bodies along a vertical and/or horizontal axis such that the orientation of the prismatic body is correct, which obviously requires more time.

SUMMARY

The purpose of the present disclosure is to provide a solution for the aforementioned and other disadvantages.

To this end, the present disclosure relates to an insert piece for a building block, which substantially comprises a plate-shaped foot with at least one spacer perpendicular thereto, the spacer being provided with first coupling parts and second coupling parts complementary thereto which can cooperate with each other for the mutual coupling of several insert pieces, whereby the plate-shaped foot is provided with one or more through holes, whereby a first part of the through hole or holes is located in the extension of the spacers and a second part of the hole or holes is located next to the spacers and contiguous with the first part, all this such that a first insert piece can be coupled to a second insert piece by at least partially inserting the first coupling parts of the first insert piece through the second part of the hole or holes of the second insert piece and subsequently moving them until the first coupling parts of the first insert piece cooperate with the second coupling parts of the second insert piece.

Because the functionalities for coupling the insert pieces according to the present disclosure are provided on or to the spacers, the foot can be made very flat, in other words, the foot can assume the form of a very thin flat plate.

Furthermore, this implies that the first and second coupling parts are substantially on the level of the spacers and not on the level of the foot after assembly.

For this reason any dimension can be chosen for the thickness of the foot. Indeed, the first and second coupling parts are no longer a determining factor for the thickness of the foot.

This has the aspect that the joint height can be kept very limited, with the result that a foot of the insert piece is not or barely visible after assembly of several building blocks.

In some embodiments, the thickness or height of the foot h, measured perpendicular to the surface that is formed by the foot, is less than four millimetres and ideally less than three millimetres.

'Thickness or height of the foot' is thus understood to mean the dimension that determines the joint height after assembly.

For this reason, the building blocks, provided with insert pieces according to the present disclosure and embedded or applied in prismatic bodies, do not necessarily need to be grouted after assembly either. As the foot is very limited in height, the joint height between the prismatic bodies is also limited after assembly. It goes without saying that this hugely reduces the costs for erecting walls with building blocks and insert pieces according to the present disclosure. Indeed, not only are costs cut on pointing mortar or the aforementioned strips but also on labour.

Furthermore, walls, partitions and constructions with such restricted joint height are also very aesthetic and have a modern look.

Another aspect is that, thanks to the restricted height h of the foot, the building blocks can be shortened very easily to the desired length, for example to a length between a half and full length of a building block.

According to the present disclosure the first coupling part is provided on an upper surface of the insert piece, and consequently also of the building block, and the second coupling part is provided on a bottom surface of the insert piece, and consequently also of the building block, with the aim of being able to couple building blocks stacked on each other by connecting the complementary first and second coupling parts.

'Bottom surface of the insert piece or the building block' is understood to mean here the surface oriented toward the foundation of the building or construction whereas upper surface is understood to mean the surface that is oriented away from the foundation of the building or construction.

The aforementioned distance between the first and second coupling parts is, for example, five, ten or fifteen centimetres.

In some embodiments, the spacers are provided with a head in which, at a certain distance from a free end of the head, a peripheral groove is applied to form the first coupling part whereas the spacers, at a fixed end that is connected to the foot, are provided with one or more hook-shaped tongues and one or more snap-ins to form the second coupling part. The hook-shaped tongues of a first insert piece are slideable in the peripheral groove of a second insert piece and the snap-in of a first insert piece can snap over an edge of the head of a second insert piece. In this way several building blocks can be coupled to each other in a very simple manner.

According to a special aspect the snap-ins are detachable again after snapping, such that the insert pieces can be reused.

According to the present disclosure the foot is provided with one or more through holes, more specifically a first part under and a second part next to the spacers, whereby the second part is located contiguous with the first part, whereby the dimensions of the through hole are such that the head of a first insert piece can be inserted through the hole of a second insert piece and after which the first insert piece can be coupled to the second insert piece, more specifically, by moving the first and/or the second insert piece.

The aforementioned move can be any movement, for example a translation, a rotation, a linear movement, a curved movement or a combination of one of the previous movements.

In some embodiments, the aforementioned move is a translation whereby a relative movement occurs of the insert pieces toward each other according to a direction perpendicular to the axis of the spacers or according to a direction parallel with the longitudinal direction of the foot.

In some embodiments, the foot of the insert piece is provided with one or more holes for hooking in a cavity hook.

This allows an outer cavity leaf to be secured to an inner cavity leaf in a simple manner.

In some embodiments, the prismatic bodies are made from stone, for example concrete, aerated concrete, baked clay or ceramics.

'Stone' or 'stones' in this text is understood to mean each material commonly used for producing building blocks.

Moreover, the prismatic bodies can be facing bricks or bricks for erecting interior walls, such as for example breeze blocks.

In some embodiments, the insert piece is made from synthetic material.

In some embodiments, the insert piece is made from high density polyethylene (HDPE).

Such synthetic material can withstand considerable tensile forces, whereas there is still a certain elasticity.

The present disclosure also relates to a building block provided with an insert piece according to the invention.

The present disclosure also relates to a wall made with building blocks according to the present disclosure.

Such wall is formed by rows of building blocks, comprising prismatic bodies and insert pieces, whereby the insert pieces of adjacent rows are mechanically coupled to each other such that a connection is realised between adjacent building blocks.

The spacers of the insert pieces extend vertically through passages in the prismatic bodies.

Although this text usually talks of a prismatic body, in practice this will typically concern a stone or brick, usually rectangular, but other materials and shapes are not excluded.

DETAILED DESCRIPTION

Figure 1:
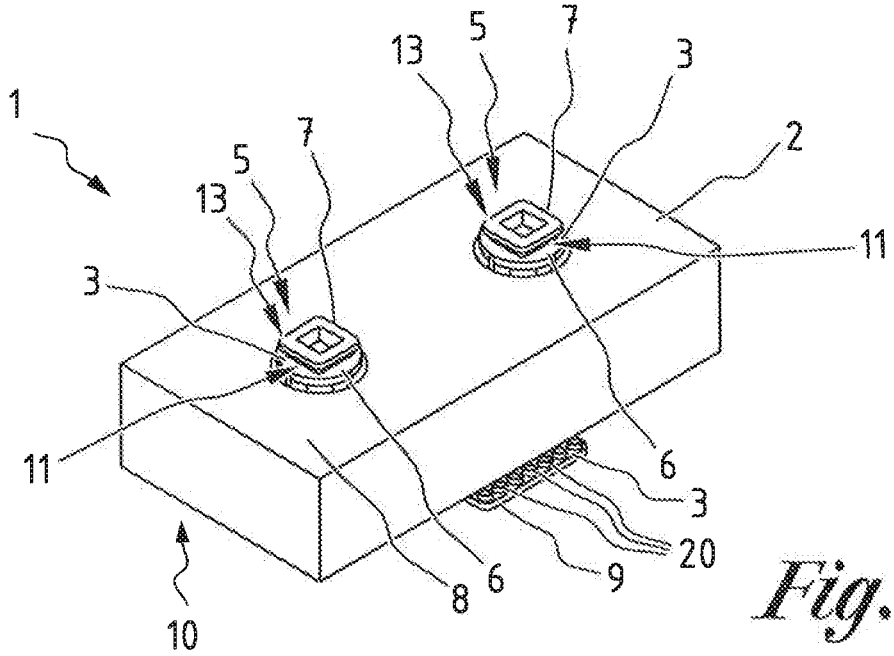
FIG. 1 schematically shows a perspective view of a building block provided with an insert piece according to the present disclosure.

The building block 1 shown in FIG. 1 comprises a prismatic body 2 whereby, in this case, one insert piece 3 is applied according to the present disclosure. Such building block 1 is intended for erecting walls 4 or partitions of a building, construction or the like.

For example, the prismatic body 2 is a traditional brick, but alternatively can also be another stone. For example, a stone made from concrete, aerated concrete, baked clay or ceramics.

In some embodiments, the insert piece 3 is made from a synthetic material, for example high density polyethylene (HDPE).

The prismatic body 2 is provided with two passages 5 in this embodiment. A spacer 6 of an insert piece 3 extends vertically through every passage 5.

A free end 7 of the spacers 6 extends above an upper surface 8 of the prismatic body 2.

A section of a foot 9 of the insert piece 3 also protrudes from the contours of a bottom surface 10 of the prismatic body 2, which is discussed in more detail here below.

Figure 2:
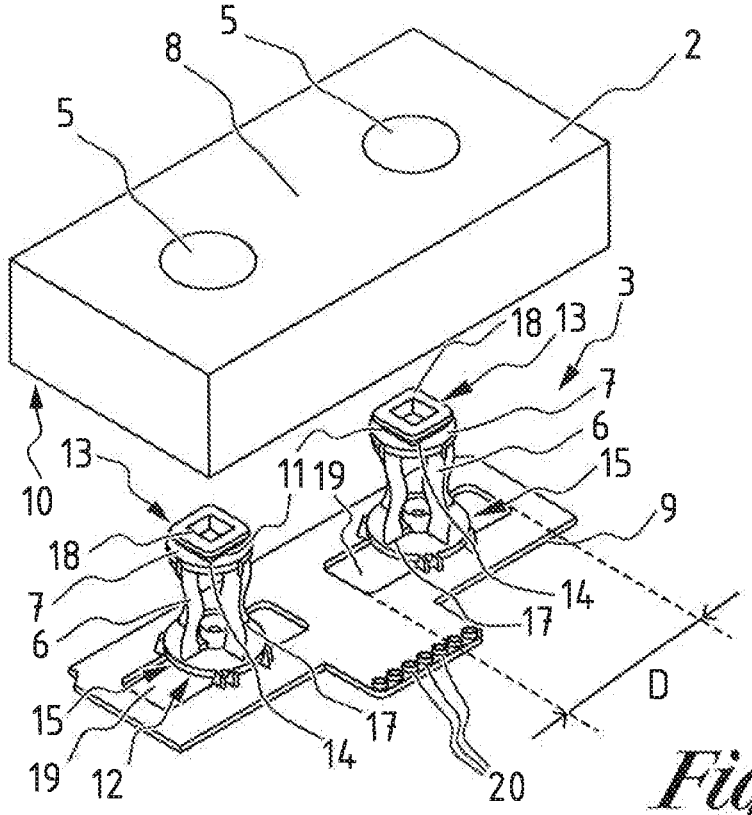
FIG. 2 shows the disassembled building block of FIG. 1.

FIG. 2 shows the disassembled building block 1, such that chiefly the different functionalities of the insert piece 3 are better reflected.

The insert piece 3 comprises, as described above, a foot 9 on which the two spacers 6 extend perpendicularly or practically perpendicularly. In this example, the spacers 6 substantially take on the form of hollow cylindrical tubes.

It is important to remember that the thickness h of the foot 9 in this example amounts to only three millimetres.

Although the thickness of the foot 9 could also be less than three millimetres, it can also be up to four millimetres thick at most.

The insert piece 3 is provided with first coupling parts 11 and second coupling parts 12 that are complementary to each other. The first coupling part 11 and the second coupling part 12 are both part of the spacers 6.

The goal of the first coupling parts 11 and second coupling parts 12 is to be able to couple building blocks 1 stacked on each other by connecting the complementary first coupling parts 11 and second coupling parts 12.

Figure 3:
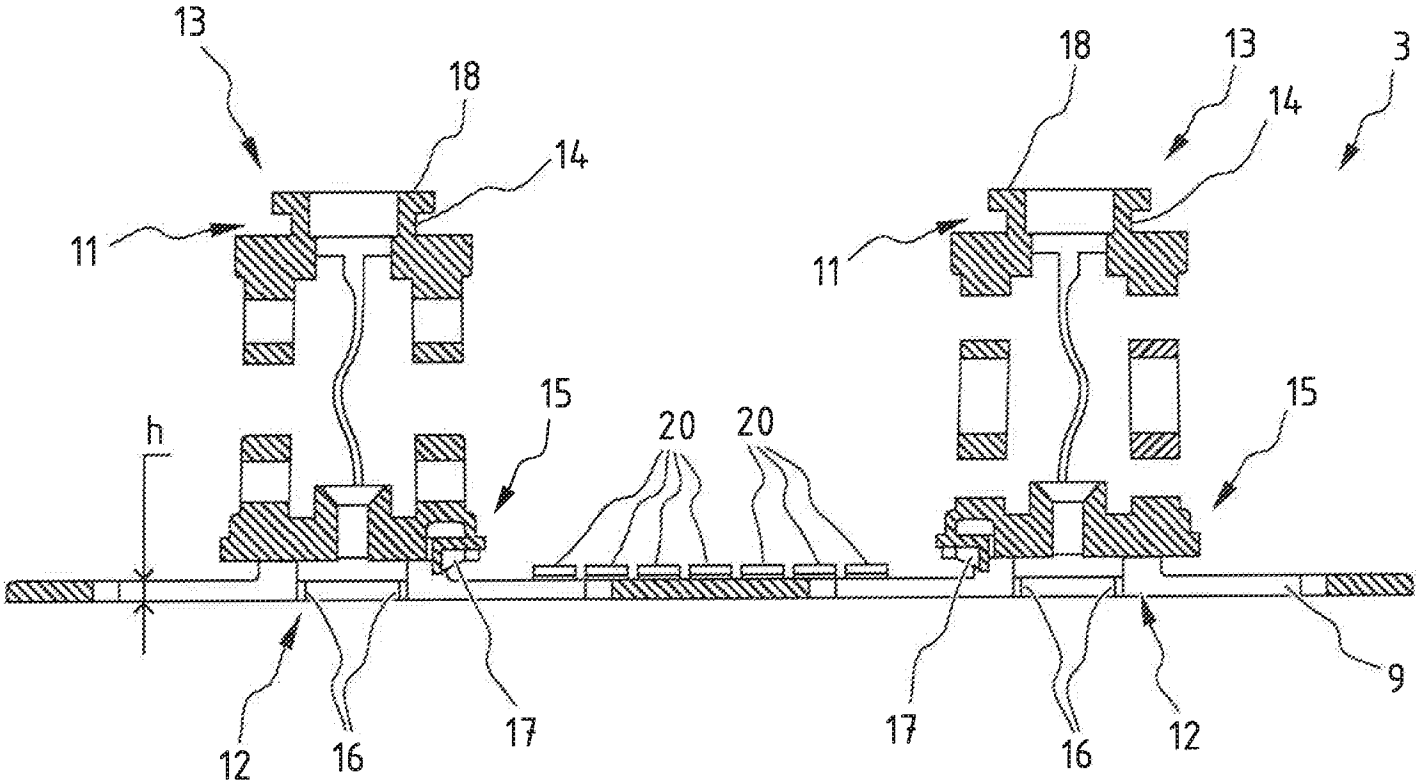
FIG. 3 shows a cross-section of the component in FIG. 2 according to line III-III.

As shown in FIGS. 2 and 3 the spacers 6 are provided with a head 13 in which a peripheral groove 14 is applied at a certain distance from the free end 7 of the head 13.

In the example shown, the peripheral groove 14 forms the first coupling part 11.

At a fixed end 15 of the spacers 6 that is connected with the foot 9, the spacers 6 are provided with one or more hook-shaped tongues 16 and one or more snap-ins 17.

The hook-shaped tongues 16 and snap-ins 17 form the second coupling part 12.

The hook-shaped tongues 16 of a first insert piece 3 are slideable in the peripheral groove 14 of a second insert piece 3.

The snap-ins 17 of a first insert piece 3 can snap over an edge 18 of the head 13 of a second insert piece 3.

FIGS. 2 and 3 also clearly show that the foot 9 is provided with two through holes 19 under and next to each spacer 6.

It is also possible that there is only one through hole 19 that continues under both spacers 6.

Obviously the foot 9 then loses strength if one instead of two separate through holes 19 is used.

The dimensions of the through holes 19 are such that the heads 13 of a first insert piece 3 can move or be guided at least partially through the hole 19.

Figure 4:
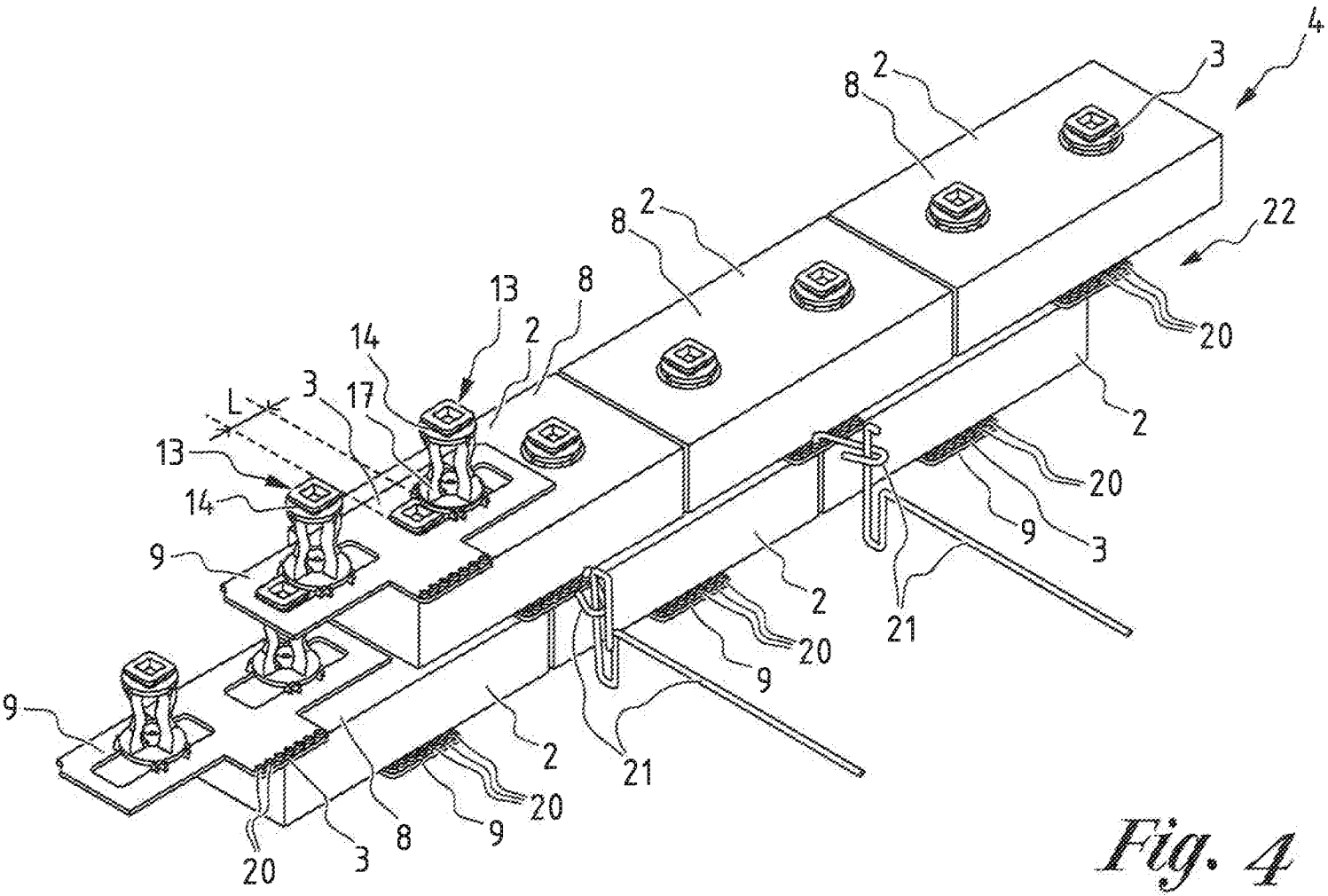
FIG. 4 shows a partially finished wall made from building blocks according to the present disclosure.

This situation is shown in FIG. 4, more specifically, in the far left section of the figure, where the heads 13 of the first or lower insert pieces 3 are already partially inserted through the through holes 19 of the second or upper insert piece 3 and next to the spacers.

To connect the first insert piece 3 to the lower insert pieces 3, in this example it suffices to simply make a sliding movement with the upper insert piece 3 in the direction perpendicular to the axis of the spacers 6 or in the longitudinal direction of the foot 9 and in the case of this figure to the left by applying and sliding the heads 13 of the lower insert pieces 3 with their peripheral grooves 14 into the hook-shaped tongues 16 of the upper insert piece 3 until the snap-ins 17 of the upper insert piece 3 snap over the edge 18 of the heads 13 of the lower insert piece 3.

In this case the snap-ins 17 are detachable again after snapping by using a device, for example a screwdriver. By pushing down the snap-ins 17 with the device, the insert pieces 3 are slideable again relative to each other, such that the insert pieces 3 can be recovered and reused.

The through hole or holes 19 are provided with a length D, measured in the longitudinal direction of the foot 9, whereby the aforementioned move, upon coupling the upper insert piece 3 and the lower insert pieces 3, comprises a translation over a length L, whereby the length L less is than a length D.

In this example, the length L is approximately as great as the width of the first coupling parts 11 and thus also as great as the width of the head 13.

In this example the length D is equal to three times the length L. Consequently the heads 13 of the lower insert pieces 3 can be inserted both to the left and right next to the spacers 6 of the upper insert piece 3.

Alternatively, the length D can, for example, also be greater or equal to twice the length L. In this case the heads 13 of the lower insert pieces 3 can be inserted exclusively to the left or right next to the spacers 6 of the upper insert piece 3.

In this example, after coupling the insert pieces 3, the axes of the spacers 6 of insert pieces 3 stacked on top of each other lie in each other's extension. In this example, the insert pieces are staggered over ½ length of the prismatic bodies 2 such that a stretcher bond is obtained.

To properly show the cooperation of the first coupling parts 11 and second coupling parts 12, the prismatic body 2 is not shown in the far left section of the figure.

FIG. 4 further also shows a partially finished wall 4 with building blocks 1 according to the present disclosure, whereby two rows of building blocks 1 are already coupled to each other.

The sections of the feet 9 of the insert pieces 3 protruding from the contours of the bottom surfaces 10 of the prismatic bodies 2 are provided with seven holes 20 in this case.

However, the number of holes 20 may vary between one and twenty-five.

The holes 20, as shown in FIG. 4, are useful for hooking in cavity hooks 21. The cavity hooks 21 allow the outer cavity leaf 22 shown here to be anchored to an inner cavity leaf (not shown).

As the feet 9 of the insert pieces 3 in this embodiment are only three millimetres thick, the joint height or the distance between two different rows of building blocks 1 is equal to approximately three millimetres.

The result is a very modern and nice looking wall 4, that does not have to be grouted. In this way pointing mortar and labour are saved or have even become unnecessary.

In view of the restricted thickness of the feet 9, the feet of the insert pieces 3 of a completely finished wall 4, are practically or even completely, invisible to the naked eye. Of course as seen from the front side of the wall 4, i.e. the side of the wall 4 oriented away from the holes 20 for hooking in the cavity hooks 21 and this is also the side that will remain visible after building the inner cavity leaf and the outer cavity leaf 22.

Although a section of a facing brick or outer cavity leaf 22 is shown in FIG. 4, the present disclosure is also applicable for erecting interior walls or an inner cavity leaf.

The present disclosure is not limited to the embodiments described as an example and shown in the drawings, but a building block as well as an insert piece for producing such building blocks according to the present disclosure can be realised in all kinds of forms and dimensions without departing from the scope of the present disclosure.

The invention claimed is:

1. An insert piece system for a building block, the insert piece system comprises at least first and second insert pieces, each insert piece comprising:

a plate-shaped foot having one or more hollow cylindrical tube-shaped spacers positioned perpendicular thereto and projecting upwardly therefrom, the spacers being provided with first coupling parts and second coupling parts complementary thereto which cooperate with each other for mutual coupling of the insert pieces, wherein the plate-shaped foot is provided with one or more through holes, a first part of the through hole or holes is located in an extension portion of the spacers and a second part of the hole or holes is located next to the spacers and contiguous with the first hole part such that the first insert piece is configured to be coupled to the second insert piece by at least partially inserting the first coupling parts of the first insert piece through the second part of the hole or holes of the second insert piece and subsequently moving each insert piece until the first coupling parts of the first insert piece cooperate with the second coupling parts of the second insert piece.

2. The insert piece system according to claim 1, wherein a thickness of the foot is less than four millimetres.

3. The insert piece system according to claim 1, wherein the first coupling parts and the second coupling parts are provided on the spacers.

4. The insert piece system according to claim 1, wherein the foot of the insert pieces is provided with one or more holes for hooking in a cavity hook.

5. The insert piece system according to claim 1, wherein the spacers are provided with a head in which at a certain distance from a free end of the head, a peripheral groove is applied to form the first coupling part and wherein the spacers at a fixed end that is connected to the foot, are provided with one or more hook-shaped tongues and one or more snap-ins to form the second coupling part, the hook-shaped tongues being able to slideably engage with the peripheral groove of the first insert piece and the snap-ins being snappable over an edge of the head of the second insert piece.

6. The insert piece system according to claim 5, wherein the snap-ins are detachable, such that the insert pieces are configured to be reused.

7. The insert piece system according to claim 1, wherein the through hole or holes are provided with a first length, measured in a longitudinal direction of the foot, and the moving upon coupling the first insert piece and the second insert piece comprises a translation over a second length, wherein the second length less is than the first length.

8. The insert piece system according to claim 7, wherein the first length is greater or equal to twice the second length.

9. The insert piece system according to claim 7, wherein the first length is greater or equal to three times the second length.

10. A system for erecting walls of a building or construction, comprising:

a building block defined by a prismatic body having one or more passages penetrating therethrough; and one or more of the insert piece systems according to claim 1, wherein respective said insert pieces are configured to extend vertically through respective said passages of the block.

11. A building structure constructed with the system according to claim 10, comprising:

one or more walls formed by rows of a plurality of the building blocks, and the insert pieces, wherein the insert pieces of adjacent rows are mechanically coupled to each other such that a connection between adjacent said building blocks is realised, wherein the spacers of the insert pieces extend vertically through the respective passages.

* * * * *